US006108020A

United States Patent [19]

Oshima

[11] Patent Number: 6,108,020

[45] Date of Patent: Aug. 22, 2000

[54] IMAGE GENERATION-TRANSFER CASSETTE

[75] Inventor: Katuyuki Oshima, Okayama, Japan

[73] Assignee: Dai Nippon Printing Co., Ltd., Tokyo

[21] Appl. No.: 09/406,848

[22] Filed: Sep. 29, 1999

[51] Int. Cl.[7] ..... B41J 32/00

[52] U.S. Cl. ..... 347/214

[58] Field of Search ..... 347/214, 213; 400/207, 208, 208.1

[56] References Cited

U.S. PATENT DOCUMENTS 5,707,925 1/1998 Akada et al. ..... 503/227
5,940,111 8/1999 Akada et al. ..... 347/213

FOREIGN PATENT DOCUMENTS 62-238791 10/1987 Japan .
4-133793 5/1992 Japan .

*Primary Examiner*—Huan Tran
*Attorney, Agent, or Firm*—Morgan, Lewis & Lewis LLP

[57] ABSTRACT

An image generation-transfer cassette forms an image on a cooperating member. The image generation-transfer cassette includes a cassette body, an image generation medium disposed in the cassette body, and an intermediate transfer recording medium disposed in the cassette body to face the image generation medium. The intermediate transfer recording medium has a substrate layer and an image receiving layer releasably disposed on the substrate layer. The image generation medium generates the image onto the image receiving layer, and the image receiving layer is transferred onto the cooperating member.

9 Claims, 3 Drawing Sheets

IMAGE GENERATION-TRANSFER CASSETTE

This application claims the benefit of Application No. 10-276694, filed in Japan on Sep. 30, 1998, which is hereby incorporated by reference.

BACKGROUND OF THE INVENTION

1. Field of the Invention

The invention relates to an image generation-transfer system and, more particularly, to an image generation-transfer cassette that generates an image on a receiving layer of a intermediate image transfer recording medium and transfers the receiving layer onto a cooperative member simultaneously.

2. Discussion of the Related Art

Various techniques are known for transferring an image onto a cooperative member (i.e., an object to receive the image). For example, Japanese Laid-Open Patent Application Nos. 62-238791 and 4-133793 disclose methods for transferring an image on a receiving layer of an intermediate image transfer recording medium onto a cooperative member. Generally, in the disclosed methods, an intermediate image transfer recording layer is generated having an image receiving layer releasably disposed on a substrate layer. A dye transferred image is then formed on the image receiving layer by using image generation sheet (i.e., an image generating process). Subsequently, the image on the image receiving layer is transferred onto a cooperative member (i.e., an image transfer process). Accordingly, an image can be formed on a cooperative member having a surface with poor dyeability or asperity. Further, the image quality is less affected by the asperity and texture of the surface of the cooperative member.

However, in the conventional method, the two separate processes (i.e., the image generating process and the image transfer process) are required. Thus, the conventional methods suffer from limited efficiency.

SUMMARY OF THE INVENTION

Accordingly, the present invention is directed to an image generation-transfer cassette that substantially obviates one or more of the problems due to limitations and disadvantages of the related art.

An object of the invention is to provide an image generation-transfer cassette that can generate an image on the image transfer recording layer and substantially simultaneously transfer the image to a cooperative member.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an image generation-transfer cassette for forming an image onto a cooperating member including a cassette body; an image generation medium disposed in the cassette body; an intermediate transfer recording medium disposed in the cassette body to face the image generation medium, the intermediate transfer recording medium having a substrate layer and an image receiving layer releasably disposed on the substrate layer, wherein the image generation medium generates the image onto the image receiving layer, and wherein the image receiving layer is transferred onto the cooperating member.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

The structure of an image generation transfer cassette in accordance with an embodiment of the present invention will now be described with reference to FIG. 1.

Figure 1:
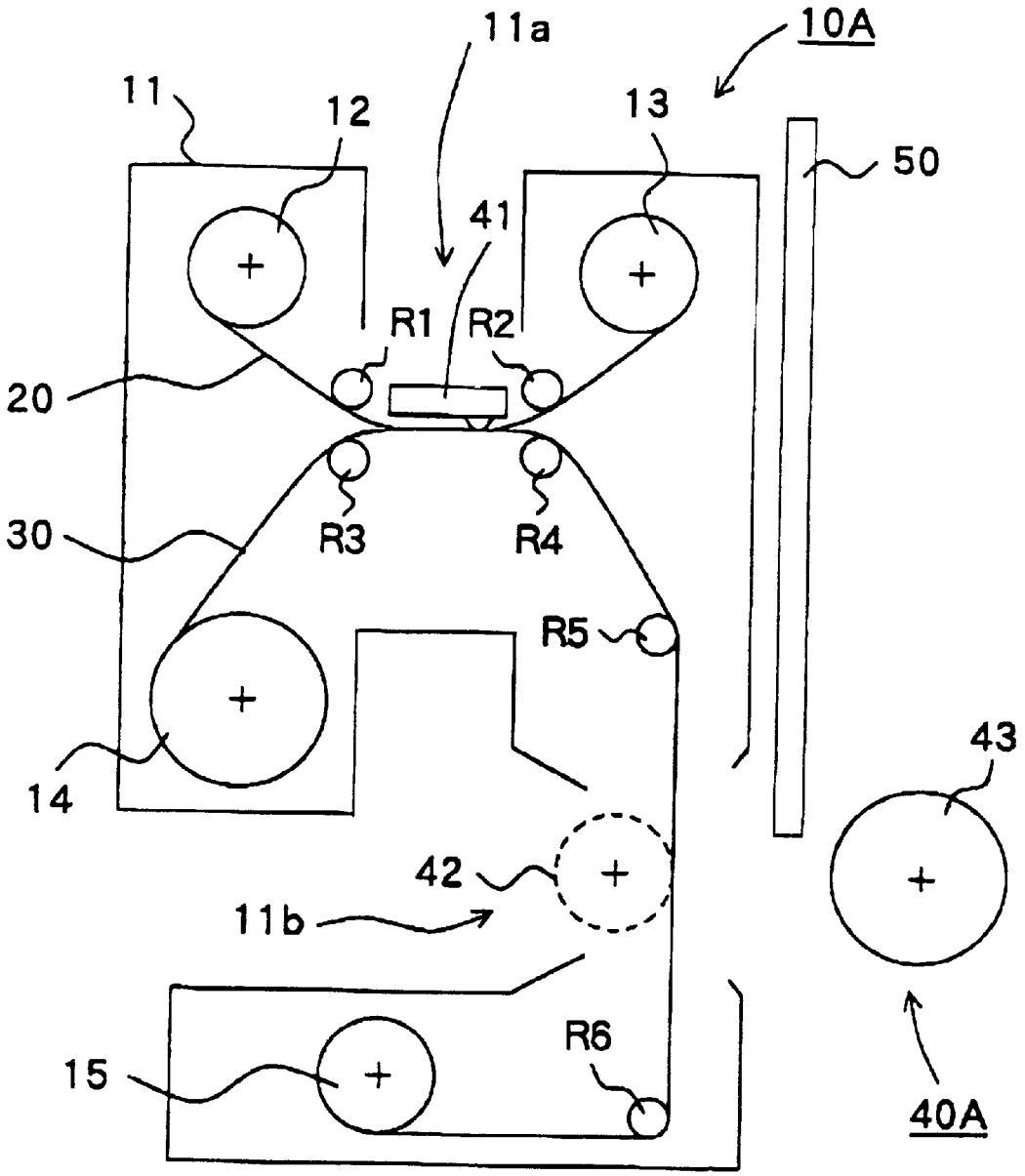
FIG. 1 is a schematic diagram of the image generation-transfer cassette according to an embodiment of the present invention.

As shown in FIG. 1, the image generation-transfer cassette 10A comprises a cassette body 11 and an intermediate transfer recording medium 30. Here, the cassette body 11 includes a case to contain an image generation sheet 20 and the intermediate transfer recording medium 30. In the illustrated embodiment of FIG. 1, the cassette body 11 further includes a first roll 12 on which is wound the portion of the image generation sheet 20 that has not yet been used, a second roll 13 on which is wound the portion of the image generation sheet 20 that has been used, and guide rollers R1, R2 that guide the image generation sheet. Moreover, the cassette body 11 includes rolls 14, 15 and guide rollers R3, R4, R5, R6 for conducting the intermediate transfer recording medium 30. In addition, the cassette body 11 defines a first opening space 11*a* in which a thermal head 41 (as an image generating device) is disposed to transfer the image from the image generation sheet 20 to an image receiving layer of the intermediate transfer recording medium 30. Furthermore, the cassette body 11 defines a second opening space 11*b* in which a heat roller 42 (as an image transfer device) is disposed to transfer the image generated on the image receiving layer of the intermediate transfer recording layer 30 to the cooperating member 50.

The image generation transfer cassette 10A is generally used with an image generation-transfer apparatus 40A. The image generation-transfer apparatus 40A comprises the thermal head 41, the heat roller 42, and the platen roller 43. The cassette 10A is attached to the image generation-transfer apparatus 40A such that the first opening space 11*a* is positioned to receive the thermal head 41, and the second opening space 11*b* is positioned to receive the heat roller 42. Additionally, rolls 13, 15 are connected with a driving system of the image generation-transfer apparatus 40A for winding-up the image generation sheet 20.

Image generation sheet 20 generates an image on the image receiving layer of the intermediate transfer recording medium 30. Here, a heat transfer sheet is preferably used. The image generation sheet 20 is disposed to face the intermediate transfer recording medium 30 at the position where the thermal head 41 is disposed. The image is then transferred by the intermediate transfer recording medium 30 to a position where the heat roller 42 is disposed. Here, the image receiving layer of the intermediate transfer recording medium 30 faces to a platen roller 43 that guides the cooperating member 50 with respect to the second opening 11*b*. The image is thus transferred onto the cooperating member 50.

The operation of the image generation sheet 20, the intermediate transfer recording medium 30, and the image generation transfer cassette 10A of the embodiment of FIG. 1 will now be described in detail with reference to FIGS. 2A–2D.

Figure 2A:
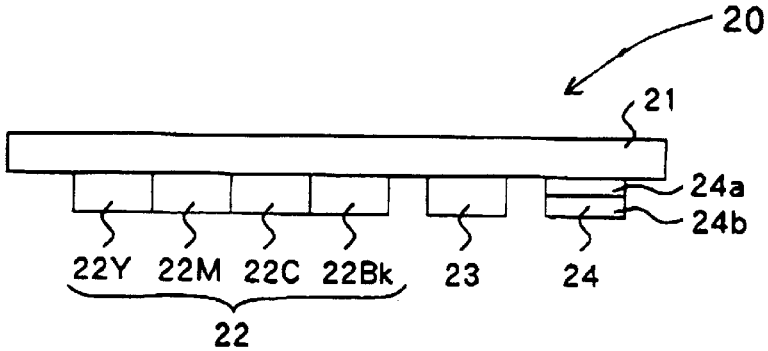
FIGS. 2A–2D are sectional views showing the image generation-transfer cassette according to an embodiment of the present invention.

FIG. 2A is a sectional view of the image generation layer 20 used in the embodiment of FIG. 1. As shown in FIG. 2A, the image generation sheet 20 comprises a layer of sublimable dye layer 22 on one side of the substrate film 21, a thermal fusion type black ink layer 23, and an adhesive layer 24. The sublimable dye layer 22 includes a yellow dye layer 22Y, a magenta dye layer 22M, a cyan dye layer 22C, and a black dye layer 22Bk. Here, an image that is generated using the image generation sheet 20 by thermal transfer has excellent gradation quality, and an image generated by using the thermal fusion type black ink layer 23 is suitable for optical character recognition (OCR).

The adhesive layer 24 includes a first adhesive layer 24*a* disposed on the sheet substrate 21, and a second adhesive layer 24*b* is disposed on the first adhesive layer 24*a*. The first adhesive layer 24*a* is formed of a material that is suitable to be adhered to the surface of the cooperative member 50, whereas the second adhesive layer 24*b* is suitable to be adhered to the receiving sheet 34 of the intermediate transfer recording medium 30. Thus, the second adhesive layer 24*b* is generally formed of a different material than the first adhesive layer 24*a*. Additionally, a release layer (not shown) can be used between the substrate sheet 21 and the adhesive layer 24. The release layer assists the release of the adhesive layer 24 from the sheet substrate 21. Also, a rubbing layer may be provided on the opposite side of the adhesive layer 24 with respect to the sheet substrate 21, thereby improving the sliding ability between the image generation sheet 20 and the thermal head 41.

Figure 2B:
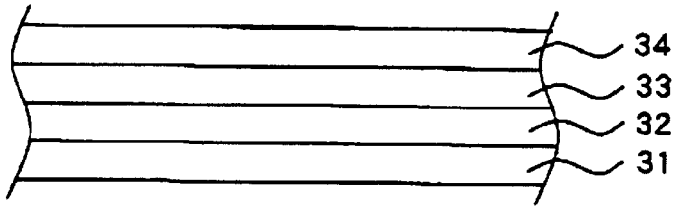

FIG. 2B is a sectional view of the intermediate transfer recording layer 30 used in the embodiment of FIG. 1. The intermediate transfer recording medium 30 includes a medium substrate 31, a releasing layer 32, a released-off layer 33, and an image receiving layer 34. Alternatively, if the medium substrate 31 is releasable, the releasing layer 32 is not needed. The released-off layer 33 assists the release of the image receiving layer 34 with the released-off layer 33 from the medium substrate 31. Here, the released-off layer 33 also acts as a protective layer to prevent the quality of the image transferred on the cooperative member 50 from being affected by surroundings, fingerprints or other contaminants. Image receiving layer 34 receives the dye of sublimable dye layer 22 of the image generation sheet 20, and the image 22T is generated.

Figure 2C:
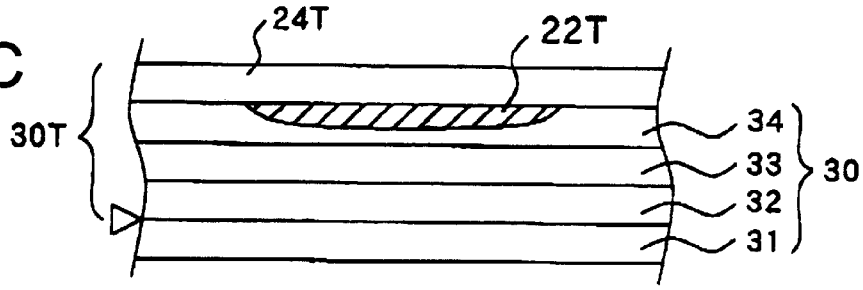

FIG. 2C is a sectional view showing intermediate transfer recording medium sheet 30 having an image 22T and adhesive layer 24T composed thereon. The image 22T and the adhesive layer 24T are composed as follows. The sublimable dyes of the image generation sheet 20 of yellow 22Y, magenta 22M, cyan 22*c*, and black 22Bk are transferred consecutively to the intermediate transfer recording layer 30, and then the thermal fusion type black ink layer 23 is transferred to make the image 22T. Next, the adhesive layer 24 is transferred on the image receiving layer 34. In the case, the second adhesive layer 24*b* of the adhesive layer 24 adheres directly to the image receiving layer 34. Also, the first adhesive layer 24*a* is easily released from the releasing surface of the sheet substrate 21 to the outermost surface of the transfer layer 30T after the second adhesive layer 24*b* was transferred thereon.

Figure 2D:
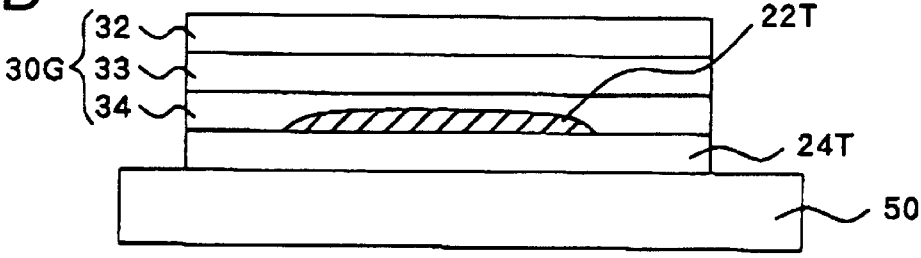

As shown in FIG. 2D, the transferred layer 30T having the image 22T on the receiving layer 34 is released from the medium substrate 31 and transferred onto the cooperative member 50. As a result, the image layer 30G is formed on the cooperative member 50.

Figure 3:
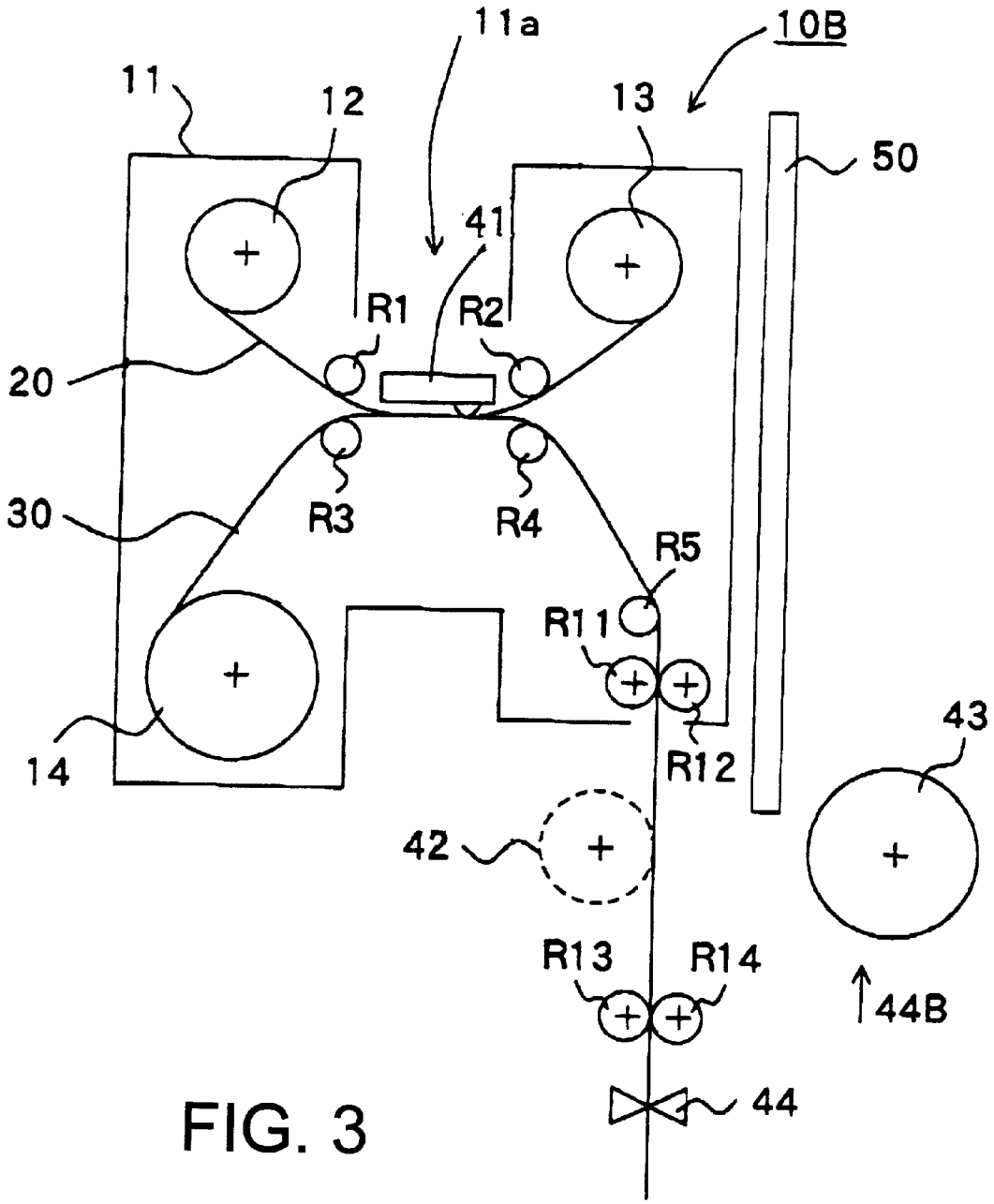
FIG. 3 is a schematic view showing another embodiment of the image generation-transfer cassette of the invention.

FIG. 3 is a schematic view showing another embodiment of the image generation-transfer cassette of the invention.

The image generation-transfer cassette of FIG. 3 does not have a roller for winding up the intermediate transfer recording medium sheet 30 after the image is transferred to the intermediate transfer recording medium sheet 30. Here, the embodiment of FIG. 3 includes nipping rollers R11, R12 that nips the intermediate transfer recording medium sheet 30 when the transfer layer 30T of the intermediate transfer recording medium 30 is transferred to the cooperative member 50. Also, the image generation-transfer apparatus includes the nipping rollers R13, R14 that nips the intermediate transfer recording medium sheet 30 when the transfer layer 30T of the intermediate transfer recording medium is transferred to the cooperative member 50, and cutter 44 to cut the intermediate transfer recording medium sheet 30 after the transfer layer 30T is transferred.

Of course, additional variations and modifications of the invention can be implemented. In exemplary alternative embodiments, the image generation-transfer apparatus may have a device that winds up the intermediate transfer recording medium after the transfer step of the transfer layer is finished. Also, the sublimable dye layer and the heat fusion type black layer do not both need to be used; one of the two can be selected according to specific application. Further, the cassette body may be configured to suit the image generation-transfer apparatus. For example, the shape, size, specific location or other characteristics of the first and the second opening spaces are changeable according to the arrangement in the image generation-transfer apparatus.

As described above, with the image generation-transfer cassette according to the invention, an image are generated and transferred at substantially the same time. For example, according to the embodiments described above, the cassette body contains the image generation sheet and intermediate transfer recording layer such that the image-generating step and the transfer step are completed substantially simultaneously. As a result, the image generation-transfer method is more efficient.

It will be apparent to those skilled in the art that various modifications and variations can be made in the image generation-transfer cassette of the present invention without departing from the spirit or scope of the invention. Thus, it is intended that the present invention cover the modifications and variations of this invention provided they come within the scope of the appended claims and their equivalents.

What is claimed is:

1. An image generation-transfer cassette for forming an image onto a cooperating member, the image generation-transfer cassette comprising:

a cassette body;

an image generation medium disposed in the cassette body;

an intermediate transfer recording medium disposed in the cassette body to face the image generation medium, the intermediate transfer recording medium having a substrate layer and an image receiving layer releasably disposed on the substrate layer, wherein the image generation medium generates the image onto the image receiving layer, and wherein the image receiving layer is transferred onto the cooperating member.

2. The image generation-transfer cassette according to claim 1, wherein the image generation medium includes a substrate portion and a colorant layer on the substrate portion, the colorant layer having at least one color layer to generate the image.

3. The image generation-transfer cassette according to claim 1, wherein the image generation medium further includes an adhesive layer formed on the substrate layer to facilitate the image receiving layer being adhered to the cooperative member when the image is transferred onto the cooperative member.

4. The image generation-transfer cassette according to claim 1, wherein the cassette body defines a first opening for receiving an image generating device to generate the image on the image receiving layer of the intermediate transfer recording medium.

5. The image generation-transfer cassette according to claim 4, wherein the image generating device includes a thermal head and the first opening is adjusted to receive the thermal head.

6. The image generation-transfer cassette according to claim 4, wherein the cassette body defines a second opening through which the image formed on the image receiving layer of the intermediate transfer recording medium is transferred to the cooperative member.

7. The image generation-transfer cassette according to claim 1, wherein the cassette body defines a second opening through which the image formed on the image receiving layer of the intermediate transfer recording medium is transferred to the cooperative member.

8. The image generation-transfer cassette according to claim 7, wherein the second opening receives a heat roller to transfer the image receiving layer having the image to the cooperative member.

9. The image generation-transfer cassette according to claim 1, wherein the intermediate transfer recording medium further includes a releasing portion disposed between the substrate layer and the image receiving layer to facilitate the separation of the image receiving layer from the substrate layer of the intermediate transfer recording medium.

* * * * *